United States Patent [19]

Naulin

[11] 3,978,738

[45] Sept. 7, 1976

[54] TOGGLE MANIPULATOR

[75] Inventor: Michel Naulin, Angouleme, France

[73] Assignee: La Telemecanique Electrique, France

[22] Filed: Dec. 24, 1974

[21] Appl. No.: 536,174

[30] Foreign Application Priority Data

Dec. 26, 1973 France ..... 73.46286

[52] U.S. Cl. ..... 74/471 XY; 74/520; 200/153 T

[51] Int. Cl.[2] ..... G05G 9/00

[58] Field of Search ..... 74/520, 471 XY; 200/153 T, 77, 153 G

[56] References Cited

UNITED STATES PATENTS 2,939,332 6/1960 Peterson ..... 74/471 XY X 3,870,161 3/1975 Cording ..... 74/471 XY X

*Primary Examiner*—Benjamin W. Wyche
*Assistant Examiner*—Frank H. McKenzie, Jr.
*Attorney, Agent, or Firm*—William Anthony Drucker

[57] ABSTRACT

Manipulator operating switches with the aid of a lever moving around a knuckle.

The lever is associated with two rectangular devices each of which being returned to the inoperative position by two levers each one associated with a spring.

Advantageous arrangement in manipulators controlling lifting gear.

5 Claims, 4 Drawing Figures

W 47
28
46-P
X
X'
53
43
44
45
31
30
37
6
48
V
α
33
50
42
W'

TOGGLE MANIPULATOR

The invention relates to a manipulator in which the movements of the operating member cause corresponding displacements of two independent pivoting devices whose axes are concurrent and perpendicular so as to constitute a knuckle and where each device comprises a component which is returned to its inoperative position by the thrust coming from one of the two levers each pivoting on the same axis as that of the device and subjected to the action of a spring one end of which is connected to the lever, the inoperative position of the operating member being determined by a position where the levers bear on a stop forming part of the framework.

Such manipulators are used to operate switches controlling, for example, lifting gear.

It is already known from the French Patent No. 1 153 152 that there is a manipulator in accordance with the former art described above. In this known contrivance no great force has to be overcome to cause displacements of the operating member, the reaction of the return spring being proportional to the amplitude of the displacement of the member, which is tolerable, taking into account the small amount of the said displacement.

The forces to be delivered if such a manipulator were associated with a group of switches with mechanical operation would however become so great that the proportional reaction of the spring of such a return system would result in excessive fatigue for the operator.

In addition, the resultant wear of the repeated impacts on the stops which govern the inoperative position would bring about play which would result in uncertainty of that position.

As, in certain applications, these manipulators are subjected to very frequent operations and as any uncertainty in the determination of the inoperative position must be avoided, the object of the invention is to provide an improved device of the kind referred to above enabling the operating forces to be rendered as constant as possible and to ensure a true and stable inoperative position in spite of wear on the moving parts.

According to the invention, this result is obtained by virtue of the fact that each lever is arranged each side of the centre of the knuckle, the return spring being hooked on the one hand to the end of the lever near the stop and on the other hand to a point on the framework such that the angle formed by the axis of the spring and the general direction of the lever is about 45° the stop being represented by a central notch made in a curved guide plate over which an element of the lever presses elastically. A complementary measure able to achieve a saving in space resulting in a long length of spring consists in the fact that the point of the framework where the fixed end of the spring is hooked is near the plane passing through the axes of oscillation of the two devices and that the axis of the spring passes near the notch acting as the stop.

In one mode of embodiment where it is proposed to provide one of the devices with a ratcheting position other than the central position, good results are obtained due to the fact that the return spring is arranged out-side the framework so as to be easily removable, that the lever and the device with which it is associated can be rendered fixed by a simple removable component and that the guide plates are formed of members easily placed inside the framework.

Other advantageous characteristics of the invention will appear from the following description and from the accompanying drawings wherein.

Figure 1:
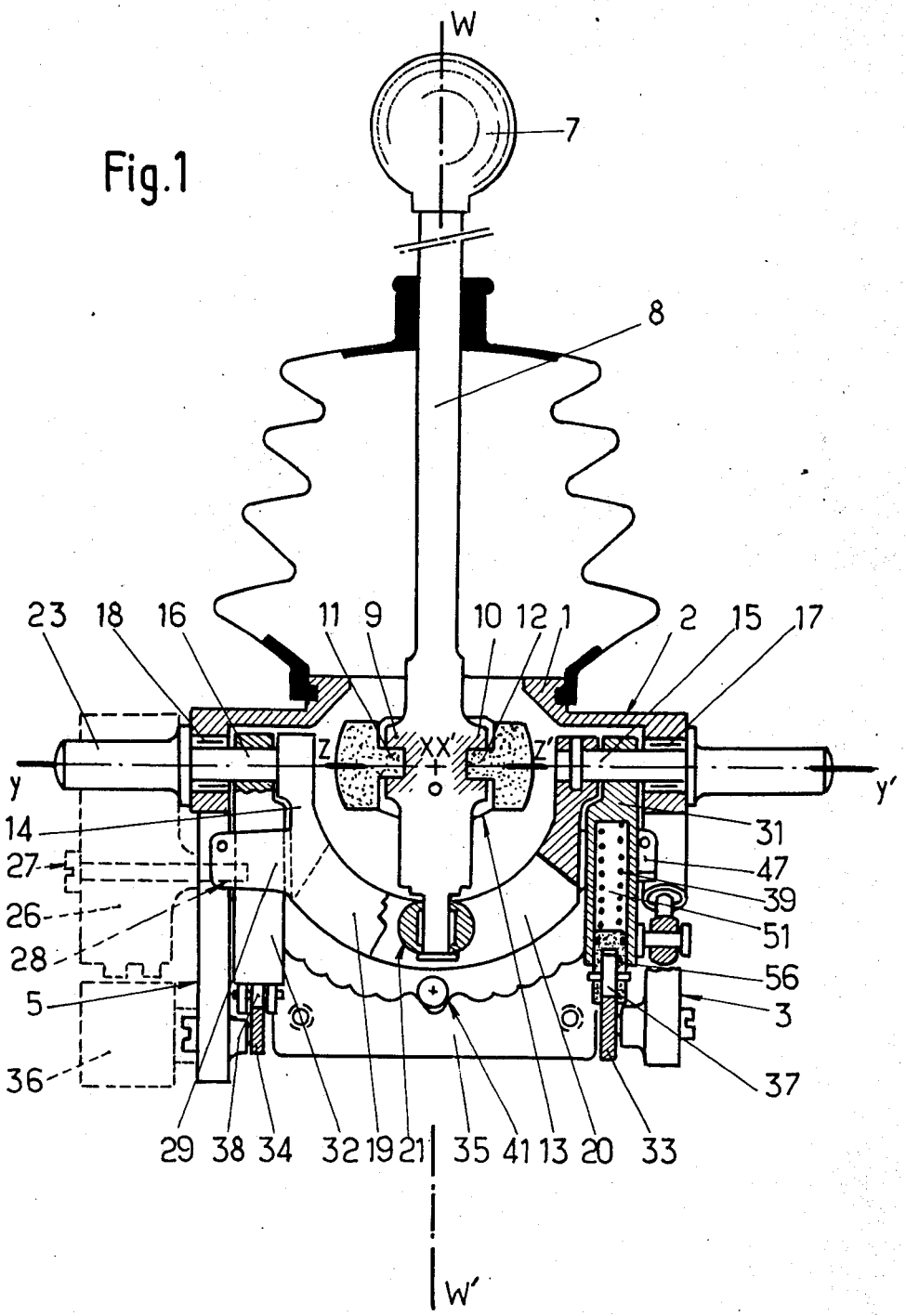
FIG. 1 represents a view in elevation of an apparatus in accordance with one preferred mode of embodiment of the invention with a partial section through a plane passing through the axis of one of the devices.
Figure 2:
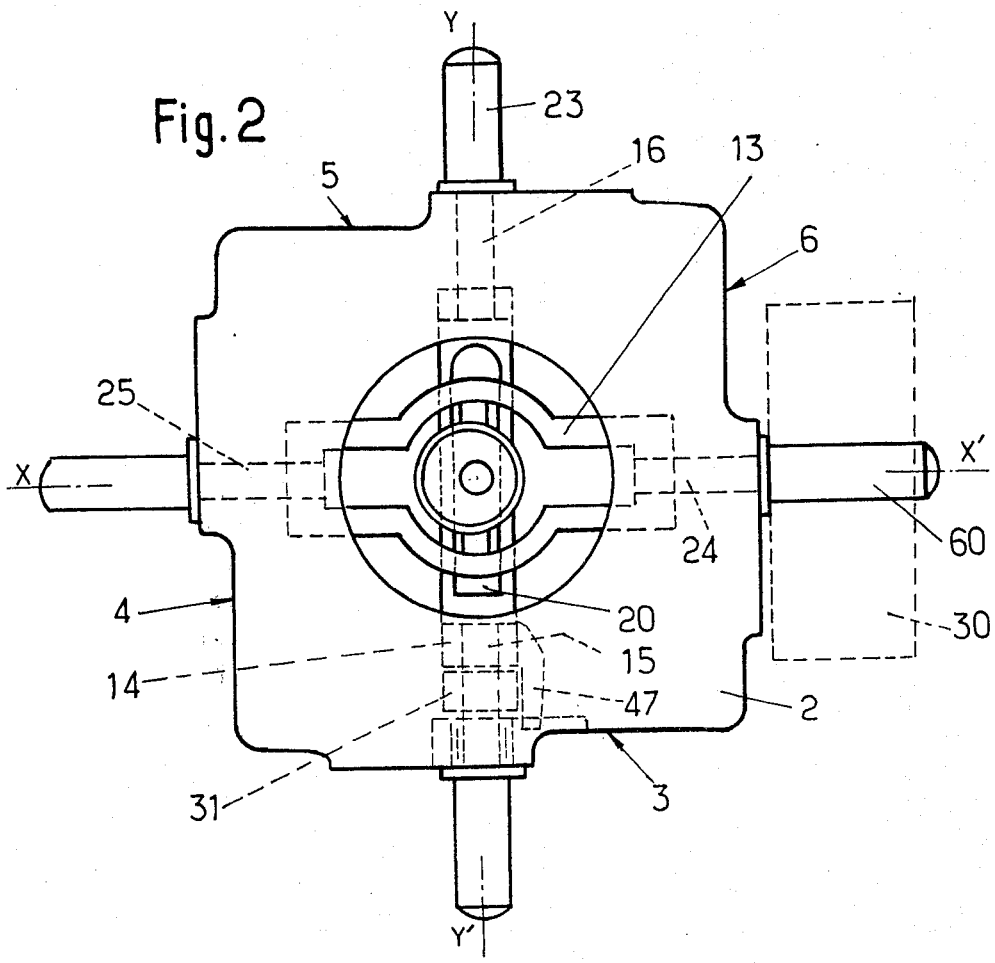
FIG. 2 is a view of the device from above

The manipulator shown in the drawing is principally composed of a body 1 having an upper face 2 serving for the fixing of the members and four portions of wall 3, 4, 5, 6 perpendicular to face 2 as can be seen in FIGS. 1 and 2.

An operating member 7 is a solid body having at the lower end a cylindrical rod 8, two bearings 9 and 10 of axis ZZ′ which enable them to move in an oscillating fashion relative to the pivots 11 and 12 forming part of a first pivoting device 13. The latter oscillates about an axis XX′ of the body 1 perpendicular to the axis ZZ′, by virtue of the journals 24,25 visible in FIG. 2.

A second pivoting device 14 visible in FIG. 1 can oscillate about an axis YY′ perpendicular to axis XX′ by virtue of the cylindrical journals 15, 16 pivoting in the bearings 17, 18 of the body 1. The axis ZZ′ coincides with axis YY′ when the member 7 is in the vertical inoperative position.

The axes XX′ and YY′ intersect at a point O which represents the centre of a knuckle allowing, between certain limits, all angular movements of the operating member.

The second device 14 has a U-shaped member 19 in which there is a recess 20 the plane of which passes through axis YY′ to receive a roller 21 which is axially fixed to the lower end of the operating member.

All positions of the operating member result in certain positions of the oscillating devices 14 and 13. At least one of the cylindrical journals 15, 16, 24, 25 has an external cylindrical extension as shown at 23, FIGS. 1 and 2 to receive a set of cams 26 shown in dotted lines in FIG. 1. These cams are intended to operate groups of contacts 36 fixed on the body.

Figure 3:
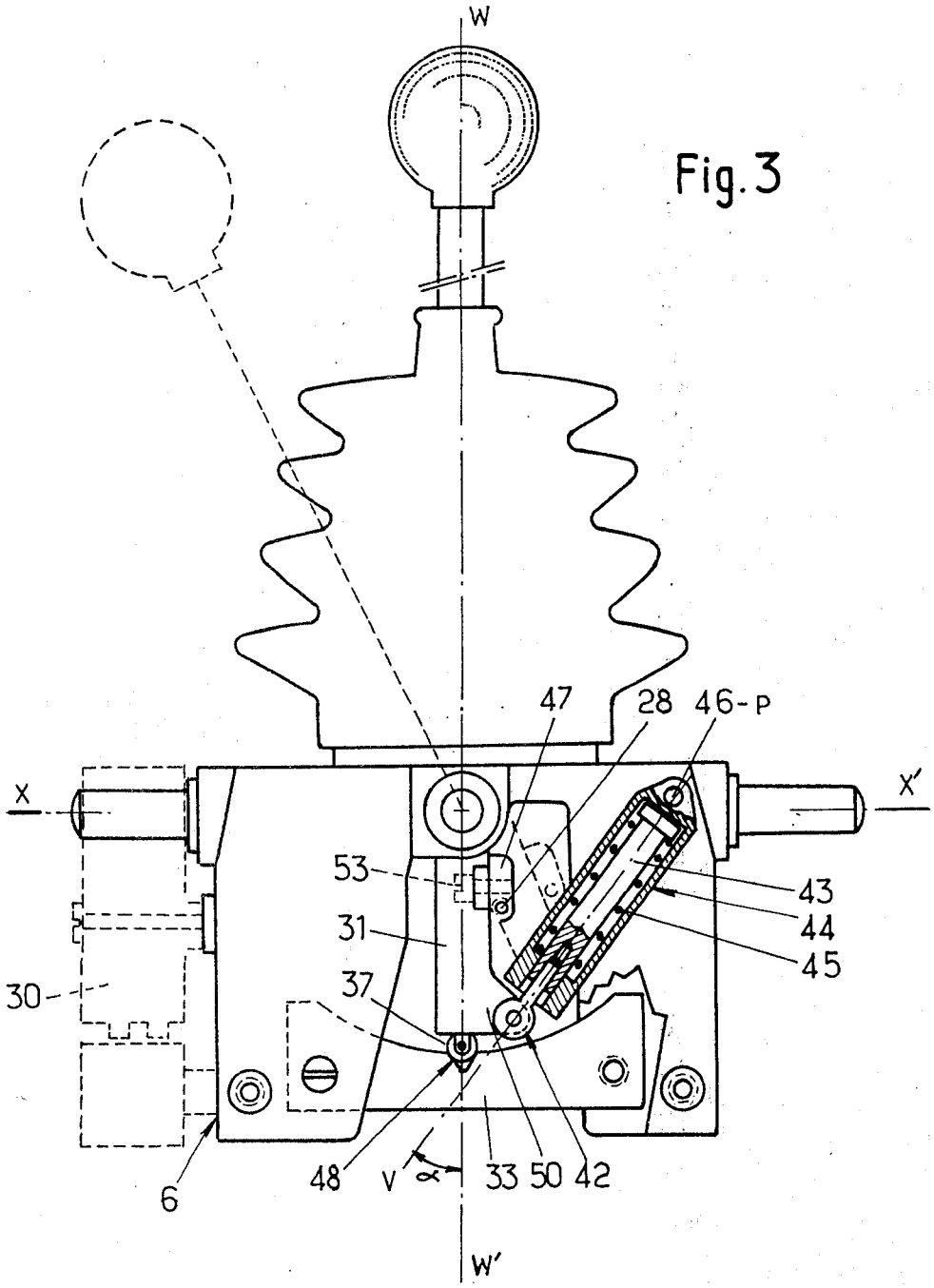
FIG. 3 is a side view of the device in which the return spring is shown in section.

This group of cams which can move in rotation about the axis of the extension 23 is fixed to the neighbouring mobile device by means of a screw 27 which passes through it and fixes in a tapped hole 28 carried by a projection 29 of the mobile device 14 (FIGS 1, 2 and 3).

In FIG. 2 there is shown by dotted lines another group of cams 30 associated with the mobile device 13 and the extension 60 of the journal 24 to cooperate with a group of contacts (not shown) fixed directly or indirectly to the wall 6.

These different contacts are operated according to the position of the mobile devices and therefore for certain positions of the operating member 7. It is frequently desired to render these various positions, as well as the central position of the operating member which must also be fixed unambiguously, sensitive to the operator. The central position of the operating member constitutes the inoperative position and particular measures have to ensure its return to this position or its tendency to return there. This function is provided for each device by two levers 31 32 which ensure the return of the device 14. A similar system (not shown) ensures the return of device 13.

In FIG. 1 can be seen that the levers 31 and 32 are pivoted on the journals 16, 15 at a point between the U shaped member 19 and the side walls 3 and 4. This interior arrangement of the levers procures a larger distance between the bearings 17, 18 which results in better resistance to forces to which the device 14 is subjected and enables guide plates 33, and 34, similar to guide plate 35 also visible in FIG. 1 to be fixed inside the walls. In this way the outer surface of the wall is free to allow the positioning of the contact groups 36.

Each of the end of the levers 31, 32 opposite the YY′ axis is equipped with a roller 37,38 respectively subjected to the action of a spring such as 39 which presses it against the guide plate 33, 34 respectively.

If the guide plate is smooth and has a certain curvature, the reactions between the roller and the guide plate result in a torque returning the lever to the central part of the guide plate.

If the guide plate has teeth, as shown at 35 in FIG. 1, each passage of the roller over their tops will produce a braking effect. All the guide plates have on the lower part a notch such as 41 sufficiently deep for the roller and as a result the lever, to rest well engaged in the corresponding position, which defines the inoperative position.

Referring to FIG. 3 the system for returning the lever 31 to the central position will be described. A dog 50 of the lever placed near the guide plate 33 comprises a stud on which is engaged the end 42 of a piston 43. The piston can move in a cylinder 44 by compressing a spring 45 placed between these latter two members. The end of the cylinder 44 opposite the guide plate is fixed to the body 1 by a cylindrical stud 46 which forms part of it.

In this type of embodiment, we see that the angle $\alpha$ formed by the general direction of the lever 31 and by the axis of the spring 45 is near 45°.

Figure 4:
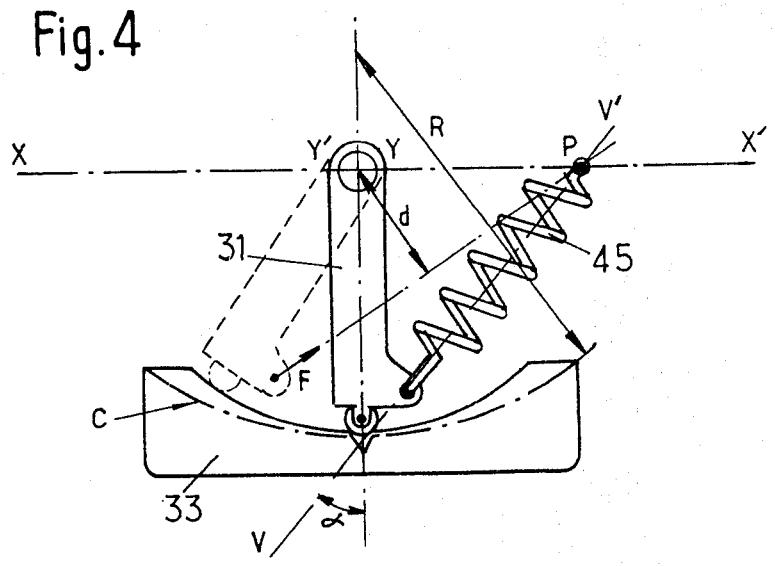
FIG. 4 represents schematically the principal restoring members.

This arrangement, shown schematically in FIG. 4 allows the spring 45 to be of great length and renders the torque necessary for the angular displacement of lever 31 appreciably constant.

In fact, when the restoring force F of the spring increases, the distance $d$ which separates the axis YY′ from the axis of the spring diminishes.

In the type of embodiment described, the point of attachment P of the spring is located near the plane passing through the axes XX′, YY′ which enables the lower part of the wall 1 to be freed so that groups of contacts can be fixed to it.

This arrangement, on the other hand results in a limitation of the possible travel of the lever 31 which can only oscillate in an angular zone to the left in FIG. 3.

As the moving device 14 has to be associated with the lever 31 and as the angular travel of the latter is half of that which can be effected by device 14, it is necessary to provide a unidirectional coupling between these two members. This coupling is obtained simply by means of a projection 47 forming part of the device 14 and bearing on the side of the lever opposite the spring 45. This projection is symmetrical with the projection 29 already described. So that lever 31 is maintained effectively in a position where the roller 37 penetrates into notch 48 in the guide plate, it is possible to compress the spring 45 beforehand in the cylinder 45 so as cause it to develop a certain force tending to displace the roller towards the right in FIG. 3.

Lever 32 in its turn is associated with a return systems identical to that which is used for lever 31 and is coupled in one direction with the mobile device 14 by a projection 29 of the latter visible in FIG. 1.

The return system however is arranged symmetrically relative to a vertical axis WW′ passing through point O and it cooperates with the guide plate 34.

The combination of the two return systems described ensures that the mobile device is maintained in its central inoperative position.

In one particular form of embodiment (FIG. 1) of the device for guiding the rollers 37, 38, the movement of the guide rod 56 which holds the roller has been used to introduce a damping effect. For this purpose the rod 56 takes the form of a piston fitted into the bore 51 of the lever 31 so as to produce compression of the air contained in the bore.

This precaution prevents rapid and repeated oscillations of the operating member when it is just released before its return to the inoperative position. In any case it is necessary to prevent the lever 31 hitting the cylinder 44.

In the case where the movement of the operating member in a certain plane necessitates the engagement of certain positions, the guide plate used has teeth as shown on the guide plate 35 in FIG. 1, whereas the lever is linked to the mobile device, for example with the aid of a screw 53 visible in dotted line in FIG. 3. In this latter case, the return system is solely obtained by the pressure that the spring 52 communicates to the roller 54.

The cylinder 44 can then be dispensed with if it is desired that the lever 31 should oscillate in the region situated to the right of the inoperative position.

Although the arrangement shown in FIG. 4 can furnish a restoring torque which does not increase appreciably when the lever 31 is displaced to the left, it is still possible to avoid operator fatigue by rendering its torque decreasing.

A simple solution enabling this result to be achieved consists in giving the guide plate 33 a curved profile shown by curve $c$ in FIG. 4 where the radius of curvature R is greater than the distance which separates the pivoting axis YY′ from the point where the notch 48 is located; by this means the spring 39 is allowed to produce a torque which is deducted from the torque exerted by the spring 47.

I claim:

1. A manipulator, for the operation of switches, comprising:

i. a body ii. a first pivoting device pivotably mounted in said body by first pivot means iii. a second pivoting device pivotably mounted in said body by second pivot means, the respective pivoting axes of said first and second pivot means being perpendicular and meeting at a point iv. a control rod mounted on said first pivoting device by means of a bearing the centre of which coincides with said meeting point, said rod having an extension in permanent contact with a portion of said second pivoting device, v. at least one lever pivotable about one of said pivot means and including an extremity which is radially resilient vi. a curved concave guide fast with the body and against which said resilient extremity abuts, said guide having a central notch in which the resilient extremity rests in a rest position of the rod vii. return spring means having first and second ends, said first end being coupled to said lever in the neighbourhood of said resilient extremity, said second end being coupled to the body at a point such that the direction of the spring means makes an angle of 45° with the direction of the lever viii. a coupling member fast with the first pivoting device and bearing against said lever in a direction corresponding to the extension of said return spring means.

2. A manipulator, as claimed in claim 1, wherein each of the two pivot means serving for mounting of the respective pivoting devices comprises an arm cooperating with a ramp, said second extremities of said return spring means for said arms being engaged respectively with the body at two points which are substantially symmetrical with respect to said meeting point.

3. Manipulator according to claim 1 characterized in that the return spring means (45) is arranged outside the body in such a way as to be easily removable, that the lever (31) and the device (14) with which it is associated can be fixed together by a simple removable member (53) and that the guide plates (33, 34, 35) consists of easily removable members placed within the body.

4. Manipulator according to claim 1 characterized in that the radius of curvature (R) of the curved guide plate (33) is greater than the distance separating the axis of rotation (YY') of lever (31) from the point where the notch (48) is located.

5. Manipulator according to claim 1 characterized in that the extremity (37) of lever (31)has by a roller associated with a piston (56) which moves in a cylindrical housing (51) to constitute a damper.

* * * * *